US010042314B2

(12) United States Patent
Tomita et al.

(10) Patent No.: US 10,042,314 B2
(45) Date of Patent: Aug. 7, 2018

(54) CLEANING DEVICE, PROCESS CARTRIDGE INCORPORATING THE CLEANING DEVICE, AND IMAGE FORMING APPARATUS INCORPORATING THE CLEANING DEVICE

(71) Applicants: Daisuke Tomita, Kanagawa (JP); Nobuo Kuwabara, Kanagawa (JP); Yasuhiro Maehata, Tokyo (JP); Norio Kudoh, Kanagawa (JP); Yasuhito Kuboshima, Tokyo (JP); Kento Aoki, Kanagawa (JP)

(72) Inventors: Daisuke Tomita, Kanagawa (JP); Nobuo Kuwabara, Kanagawa (JP); Yasuhiro Maehata, Tokyo (JP); Norio Kudoh, Kanagawa (JP); Yasuhito Kuboshima, Tokyo (JP); Kento Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/660,311

(22) Filed: Jul. 26, 2017

(65) Prior Publication Data

US 2018/0046128 A1 Feb. 15, 2018

(30) Foreign Application Priority Data

Aug. 10, 2016 (JP) ..... 2016-157095

(51) Int. Cl.
*G03G 21/00* (2006.01)

(52) U.S. Cl.
CPC ..... *G03G 21/0011* (2013.01)

(58) Field of Classification Search
CPC ..... G03G 21/0011; G03G 21/0029; G03G 21/007

(Continued)

(56) References Cited

U.S. PATENT DOCUMENTS 3,918,809 A * 11/1975 Hwa ..... G03G 21/0088 118/70
4,505,577 A * 3/1985 Koizumi ..... G03G 21/105 399/350

(Continued)

FOREIGN PATENT DOCUMENTS

| | | |
|---|---|---|
| JP | 5-100606 | 4/1993 |
| JP | 2007-292920 | 11/2007 |
| JP | 2013-073085 | 4/2013 |

OTHER PUBLICATIONS

U.S. Appl. No. 15/429,552, filed Feb. 10, 2017.

*Primary Examiner* — Billy Lactaoen
(74) *Attorney, Agent, or Firm* — Harness, Dickey & Pierce, P.L.C.

(57) ABSTRACT

A cleaning device, which is included in a process cartridge and an image forming apparatus, includes a cleaning blade configured to remove a material attached to a surface of an image bearer, a cleaning case configured to contain the material removed by the cleaning blade, and a removed material receiver configured to receive the material failed to enter into the cleaning case when the material is removed by the cleaning blade, the removed material receiver having a first range at both ends in a width direction of the cleaning blade and a second range at a center in the width direction of the cleaning blade. A volume per unit length in a width direction of the first range is greater than a volume per unit length in a width direction of the second range.

14 Claims, 4 Drawing Sheets

(58) Field of Classification Search
USPC ..... 399/350
See application file for complete search history.

(56) References Cited

U.S. PATENT DOCUMENTS

| | | | |
|---|---|---|---|
| 2009/0185842 | A1 | 7/2009 | Hatori et al. |
| 2009/0241830 | A1 | 10/2009 | Koike et al. |
| 2010/0021205 | A1 | 1/2010 | Honjoh et al. |
| 2010/0183349 | A1 | 7/2010 | Shintani et al. |
| 2010/0189461 | A1 | 7/2010 | Shintani et al. |
| 2012/0134725 | A1 | 5/2012 | Kawahara et al. |
| 2012/0315053 | A1 | 12/2012 | Kudo et al. |
| 2012/0321330 | A1 | 12/2012 | Kudo et al. |
| 2014/0270881 | A1 | 9/2014 | Gotoh et al. |
| 2014/0363178 | A1 | 12/2014 | Hatori et al. |
| 2015/0063887 | A1 | 3/2015 | Asaoka et al. |
| 2016/0011562 | A1 | 1/2016 | Shintani et al. |
| 2016/0306318 | A1 | 10/2016 | Tomita et al. |
| 2017/0102663 | A1 | 4/2017 | Tomita et al. |

* cited by examiner

CLEANING DEVICE, PROCESS CARTRIDGE INCORPORATING THE CLEANING DEVICE, AND IMAGE FORMING APPARATUS INCORPORATING THE CLEANING DEVICE

CROSS-REFERENCE TO RELATED APPLICATION

This patent application is based on and claims priority pursuant to 35 U.S.C. § 119(a) to Japanese Patent Application No. 2016-157095, filed on Aug. 10, 2016, in the Japan Patent Office, the entire disclosure of which is hereby incorporated by reference herein.

BACKGROUND

Technical Field

This disclosure relates to a cleaning device including a removed material receiver to receive materials removed from a surface of an image bearer and spilled outside a collected material storage area, a process cartridge incorporating the cleaning device, and an image forming apparatus such as a copier, printer, facsimile machine, printing machine, and a multifunction printer including at least two functions of the copier, printer, facsimile machine, and printing machine, incorporating the cleaning device.

Related Art

Known image forming apparatuses such as copiers and printers employ a technique using a cleaning device in which a removed material receiver to receive foreign materials such as toner that is spilled from the cleaning device.

To be more specific, the cleaning device includes a cleaning blade that removes foreign material such as toner attached to the surface of a photoconductor drum (i.e., an image bearer) from the photoconductor drum. The foreign material removed by the cleaning blade is collected in a collected material storage area disposed inside the cleaning device.

Further, the cleaning device includes a receiver having a substantially planar shape (i.e., a toner receiver) that is disposed at a lower part of the cleaning device. To be more specific, the substantially planar receiver is disposed at a position where the cleaning blade contacts the photoconductor drum. This receiver receives toner (foreign material) is not collected to but is leaked or spilled outside the collected material storage area. Accordingly, the image forming apparatus can be prevented from a failure such as contamination caused by the spilled toner, that is, the spilled foreign material.

SUMMARY

At least one aspect of this disclosure provides a cleaning device including a cleaning blade, a cleaning case, and a removed material receiver. The cleaning blade is configured to remove a material attached to a surface of an image bearer. The cleaning case is configured to contain the material removed by the cleaning blade. The removed material receiver is configured to receive the material failed to enter into the cleaning case when the material is removed by the cleaning blade. The removed material receiver has a first range at both ends in a width direction of the cleaning blade and a second range at a center in the width direction of the cleaning blade. A volume per unit length in a width direction of the first range is greater than a volume per unit length in a width direction of the second range.

Further, at least one aspect of this disclosure provides a process cartridge detachably attachable to an apparatus body of an image forming apparatus. The process cartridge includes the above-described cleaning device and an image bearer disposed close to the cleaning device.

Further, at least one aspect of this disclosure provides an image forming apparatus including the above-described cleaning device and an image bearer disposed close to the cleaning device.

Further, at least one aspect of this disclosure provides a cleaning device including a cleaning blade, a cleaning case, and a removed material receiver. The cleaning blade is configured to remove a material attached to a surface of an image bearer. The cleaning case is configured to contain the material removed by the cleaning blade. The removed material receiver is configured to receive the material failed to enter into the cleaning case when the material is removed by the cleaning blade. The removed material receiver has a first range at both ends in a width direction of the cleaning blade and a second range at a center in the width direction of the cleaning body. The removed material receiver includes a bottom portion, an upright portion, and a wall. The bottom portion is disposed in a lower part of the cleaning device, below a position at which the cleaning body contacts the image bearer and includes an elastic plate. The upright portion extends upright from the bottom portion, at a leading end of the bottom portion on an image bearer side in the second range and includes a rubber. The wall extends upright and surrounding an area other than a lateral center area of the bottom portion in the first range and includes a sponge.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
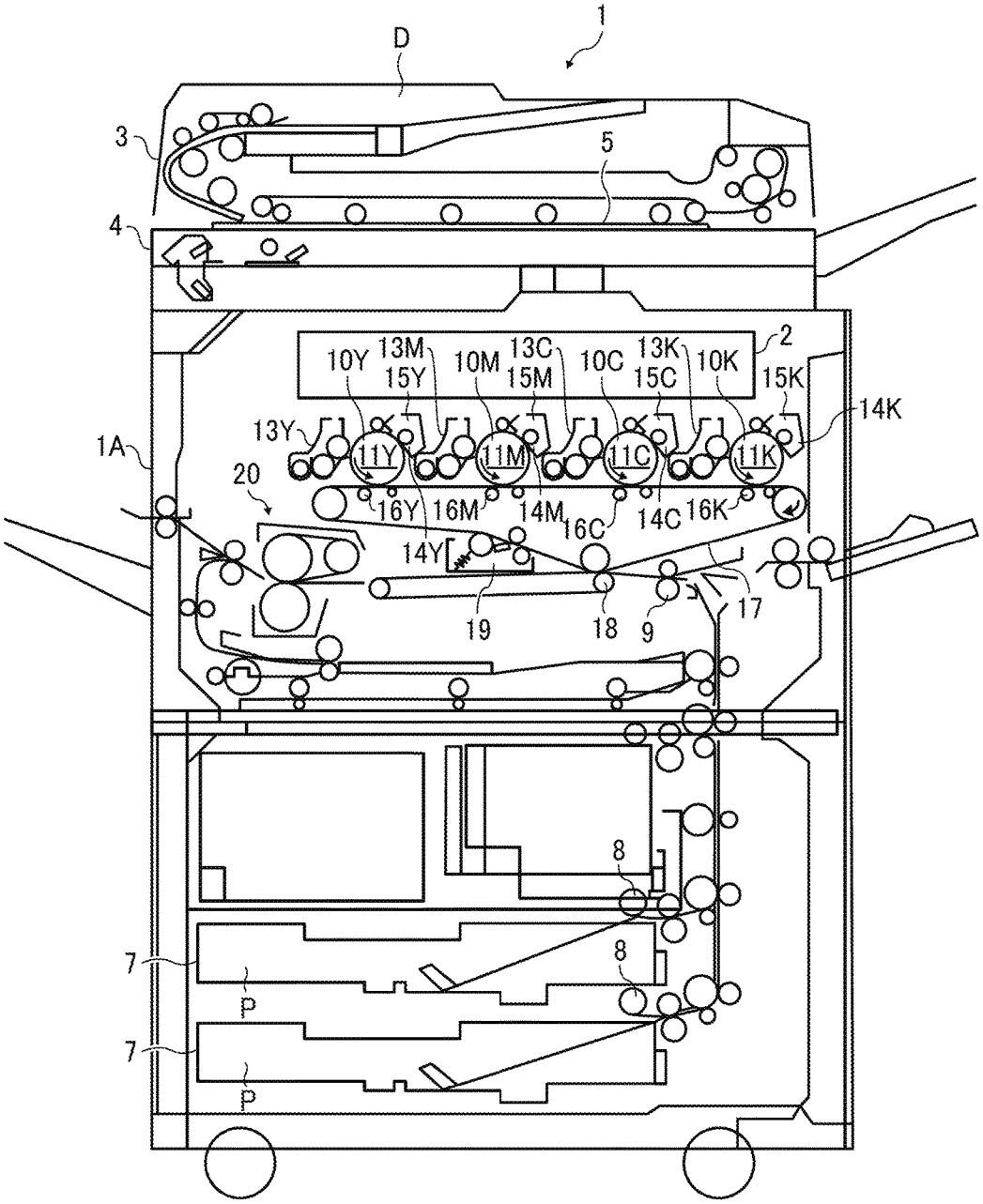
FIG. 1 is a diagram illustrating an overall configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Next, a description is given of a configuration and functions of an image forming apparatus 1 according to an embodiment of this disclosure, with reference to drawings. It is to be noted that identical parts are given identical reference numerals and redundant descriptions are summarized or omitted accordingly.

Figure 2:
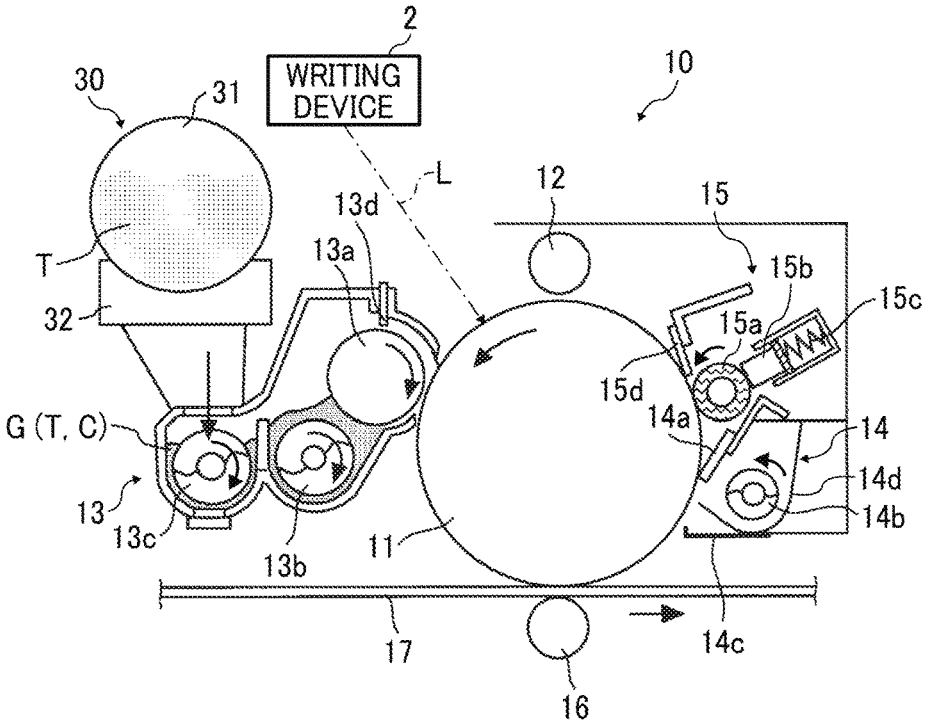
FIG. 2 is a cross sectional view illustrating a process cartridge included in the image forming apparatus.

Now, a description is given of an overall configuration and functions of the image forming apparatus 1 with reference to FIGS. 1 and 2.

FIG. 1 is a diagram illustrating an overall configuration of the image forming apparatus 1 according to an embodiment of this disclosure. FIG. 2 is a cross sectional view illustrating a process cartridge 10 for forming a single color image of any one of yellow, magenta, cyan, and black images, included in the image forming apparatus 1.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIGS. 1 and 2, the image forming apparatus 1 includes four process cartridges 10Y, 10M, 10C, and 10K. The four process cartridges 10Y, 10M, 10C, and 10K basically have an identical configuration to each other, except that the colors of respective toners T used form image forming processes are different, which are yellow (Y), magenta (M), cyan (C), and black (K). Therefore, the following description is given with reference numeral "10" without any suffix, Y, M, C, and K, but is applied to any one of the process cartridges 10Y, 10M, 10C, and 10K.

In FIG. 1, the image forming 1 functions as a tandem-type color copier and includes an apparatus body 1A that includes an optical writing device 2, a document feeding device 3, a document reading device 4, sheet feeding devices 7, a pair of registration rollers 9, the process cartridges 10Y, 10M, 10C, and 10K, primary transfer rollers 16Y, 16M, 16C, and 16K, an intermediate transfer belt 17, a secondary transfer roller 18, an intermediate transfer belt cleaning device 19, and a fixing device 20.

The optical writing device 2 emits laser light based on inputted image data.

The document feeding device 3 transfers an original document D to the document reading device 4.

The document reading device 4 reads the inputted image data of the original document D.

The sheet feeding devices 7 accommodates recording media including a recording medium P such as a transfer sheet.

The pair of registration rollers 9 adjust timing of conveyance of the recording medium P.

The process cartridges 10Y, 10M, 10C, and 10K form yellow, magenta, cyan, and black images, respectively.

The primary transfer rollers 16Y, 16M, 16C, and 16K sequentially transfer respective images formed on the surfaces of the process cartridges 10Y, 10M, 10C, and 10K, respectively, onto the intermediate transfer belt 17.

The intermediate transfer belt 17 receives the respective toner images transferred onto the surface thereof to form a composite toner image.

The secondary transfer roller 18 transfers the composite toner image formed on the surface of the intermediate transfer belt 17 onto the recording medium P.

The intermediate transfer belt cleaning device 19 cleans the surface of the intermediate transfer belt 17.

The fixing device 20 fixes the composite toner image (an unfixed image) formed on the recording medium P to the recording medium P.

Now, a description is given of regular color image forming operations performed by the image forming apparatus 1.

The original document D is fed from a document loading table provided to the document feeding device 3 and conveyed by multiple pairs of sheet conveying rollers disposed in the document feeding device 3 in a direction indicated by arrow in FIG. 1, to the exposure glass 5 provided to the document reading device 4. The document reading device 4 optically reads image data of the original document D placed on the exposure glass 5.

To be more specific, the document reading device 4 scans the image formed on the original document D placed on the exposure glass 5 while emitting light generated by an illumination lamp. The light reflected on the original document D travels via mirrors and through lenses to form an image on a color sensor. The color sensor reads color image data of the original document D for each of decomposed light colors of red, green, and blue (RGB), and the converts the color image data into electrical image signals. Further, an image processor performs image processing such as color conversion, color calibration, and spatial frequency adjustment based on the electrical image signals of decomposed light colors of RGB, so as to obtain color image data of each color separated into each color data of yellow, magenta, cyan, and black.

Consequently, each color data of yellow, magenta, cyan, and black is transmitted to the optical writing device 2. Then, the optical writing device 2 emits laser light beams (exposure light) L based on the image data of the electrical image signals toward the surface of the photoconductor drum 11 (i.e., an image bearer) of the process cartridge 10 (i.e., the process cartridges 10Y, 10M, 10C, and 10K).

By contrast, the photoconductor drum 11 of the process cartridge 10 (i.e., the process cartridges 10Y, 10M, 10C, and 10K) rotates in a direction indicated by arrow of FIG. 2 (i.e., a counterclockwise direction in FIG. 2). As the photoconductor drum 11 rotates, the charging roller 12 uniformly charges a surface of the photoconductor drum 11 at a position facing each other. (This is a charging process.) As a result, a charging potential is formed on the surface of the photoconductor drum 11. Then, as the photoconductor drum 11 is rotated, the charged surface of the photoconductor drum 11 is brought to a light emitting position of each of the laser light beams L.

In the optical writing device 2, four laser light beams L corresponding to respective color image data are emitted from four light sources of different colors. The optical writing device 2 emits the laser light beams L according to image data. The four laser light beams L pass through respective optical paths for yellow, magenta, cyan, and black. (This is an exposure process.)

The laser light beam L corresponding to the yellow component is emitted to the surface of the first photoconductor drum 11 from the left of FIG. 1, that is, to the surface of the photoconductor drum 11Y in the present embodiment. At this time, a polygon mirror rotates at high speed to deflect the laser light beam L having the yellow component in a direction of rotational axis of the photoconductor drum 11 (i.e., a main scanning direction) so as to scan the photoconductor drum 11Y. According to this operation, after the surface of the photoconductor drum 11 is charged by the charging roller 12, an electrostatic latent image having the yellow component is formed on the surface of the photoconductor drum 11Y.

Similarly, the laser light beam L corresponding to the magenta component is emitted to the surface of the second photoconductor drum 11 from the left of FIG. 1, that is, to the surface of the photoconductor drum 11M in the present embodiment. Consequently, an electrostatic latent image having the magenta component is formed on the surface of the photoconductor drum 11M. The laser light beam L corresponding to the cyan component is emitted to the surface of the third photoconductor drum 11 from the left of FIG. 1, that is, to the surface of the photoconductor drum 11C in the present embodiment. Consequently, an electrostatic latent image having the cyan component is formed on the surface of the photoconductor drum 11C. The laser light beam L corresponding to the black component is emitted to the surface of the fourth photoconductor drum 11 from the left of FIG. 1, that is, to the surface of the photoconductor drum 11K in the present embodiment. Consequently, an electrostatic latent image having the black component is formed on the surface of the photoconductor drum 11K.

Then, the respective surfaces of the photoconductor drums 11Y, 11M, 11C, and 11K having the respective electrostatic latent images having the yellow, magenta, cyan, and black components, respectively, come to respective opposing positions to developing devices 13Y, 13M, 13C, and 13K. The developing device 13 (i.e., the developing devices 13Y, 13M, 13C, and 13K) supplies toner of corresponding color onto the surface of the photoconductor drum 11 (i.e., the photoconductor drums 11Y, 11M, 11C, and 11K), so that the electrostatic latent image formed on the surface of the photoconductor drum 11 is developed into a visible toner image. (This is a developing process.)

The developing device 13 (i.e., the developing devices 13Y, 13M, 13C, and 13K) supplies toner of corresponding color onto the surface of the photoconductor drum 11 (i.e., the photoconductor drums 11Y, 11M, 11C, and 11K), so that the electrostatic latent image formed on the surface of the photoconductor drum 11 is developed into a visible toner image. (This is a developing process.) Thereafter, the respective surfaces of the photoconductor drums 11Y, 11M, 11C, and 11K come to respective opposing positions to the intermediate transfer belt 17.

Primary transfer rollers 16Y, 16M, 16C, and 16K are disposed at the respective opposing positions of the photoconductor drums 11Y, 11M, 11C, and 11K to the intermediate transfer belt 17. The primary transfer rollers 16Y, 16M, 16C, and 16K are disposed in contact with an inner circumferential surface of the loop of the intermediate transfer belt 17. Then, respective single color toner images formed on the surfaces of the photoconductor drums 11Y, 11M, 11C, and 11K are sequentially transferred and overlaid onto the intermediate transfer belt 17 at the positions of the primary transfer rollers 16Y, 16M, 16C, and 16K. (This is a primary transfer process.)

After completion of the primary transfer process, the respective surfaces of the photoconductor drums 11Y, 11M, 11C, and 11K then come to respective opposing positions to cleaning devices 14Y, 14M, 14C, and 14K (i.e., respective cleaning parts). Each of the cleaning devices 14Y, 14M, 14C, and 14K includes a cleaning blade 14*a*, a conveyance screw 14*b*, a removed material receiver 14*c*, and a cleaning case 14*d*. At this position, foreign material such as untransferred toner remaining on the surface of the photoconductor drum 11 is mechanically removed by the cleaning blade 14*a*, and the removed untransferred toner (i.e., the foreign material) is collected into the cleaning case 14*d* of the cleaning device 14 (i.e., the cleaning devices 14Y, 14M, 14C, and 14K) as waste toner. (This is a cleaning process.) The untransferred toner collected into the cleaning case 14*d* of the cleaning device 14 is conveyed by the conveyance screw 14*b* toward outside of the cleaning case 14*d* of the cleaning device 14, and is then collected into inside of a waste toner collecting unit via a toner conveyance passage.

Thereafter, the respective surfaces of the photoconductor drums 11Y, 11M, 11C, and 11K pass lubricating devices 15Y, 15M, 15C, and 15K and respective electric discharging devices. After these processes, a series of image forming processes of the photoconductor drum 11 is completed.

A composite color toner image is formed on the intermediate transfer belt 17 by transferring and overlaying the respective single color toner images formed on the photoconductor drums 11Y, 11M, 11C, and 11K. Then, the intermediate transfer belt 17 moves in a clockwise direction in FIG. 1 to come to an opposing position to the secondary transfer roller 18. Then, the composite color toner image formed and borne on the intermediate transfer belt 17 is transferred onto a recording medium P at the opposing position of the secondary transfer roller 18. (This is a secondary transfer process.)

After the secondary transfer process, the surface of the intermediate transfer belt 17 comes to an opposing position to the intermediate transfer belt cleaning device 19. Consequently, foreign material such as untransferred toner remaining on the surface of the intermediate transfer belt 17 is removed and collected by the intermediate transfer belt cleaning device 19. After these processes, a series of image forming processes of the intermediate transfer belt 17 is completed.

The recording medium P that has been conveyed in a secondary transfer nip region formed between the intermediate transfer belt 17 and the secondary transfer roller 18 is conveyed via conveyance components from the sheet feeding device 7 to the pair of registration rollers 9.

To be more specific, after being conveyed by a sheet feed roller 8 of a selected one of the sheet feeding devices 7 in which multiple recording media including the recording medium P are stored, the recording medium P passes through a sheet conveyance guide to be guided to the pair of registration rollers 9 (i.e., a pair of timing rollers). The recording medium P at the pair of registration rollers 9 is conveyed toward the secondary transfer nip region at a predetermined timing.

Consequently, the recording medium P having a full color image thereon is guided by a conveyance belt to the fixing device 20. The fixing device 20 fixes the composite color toner image (toner) formed on the recording medium P to the recording medium P at a fixing nip region by application of heat applied by a fixing belt and pressure applied by a pressure roller.

After this fixing process, the recording medium P is ejected by a sheet ejecting roller to an outside of the apparatus body 1A as an output image. Accordingly, a series of image forming processes is completed.

FIG. 2 is a cross sectional view illustrating the process cartridge 10 included in the image forming apparatus 1.

As illustrated in FIG. 2, the process cartridge 10 includes the photoconductor drum 11 that functions as an image bearer, the charging roller 12 (i.e., a charging part), the developing device 13 (i.e., a developing part), the cleaning device 14 (i.e., the cleaning part), and the lubricating device 15 as a single unit.

The photoconductor drum 11 that functions as an image bearer is an organic photoconductor charged to a negative polarity. The photoconductor drum 11 includes a conductive layer overlaying a drum-shaped conductive support body.

The photoconductor drum 11 includes multiple layers including the conductive support body that functions as a base layer, an undercoat layer that functions as an insulation layer, a charge generation layer and a charge transport layer that function as a photoconductive layer, and a surface layer (i.e., a protection layer). The undercoat layer is overlaid on the photoconductive support body, the charge generation layer and the charge transport layer are overlaid on the undercoat layer, and the surface layer is formed on top of the charge generation layer and the charge transport layer.

With reference to FIG. 2, the charging roller 12 includes a conductive cored bar and an elastic layer of moderate resistivity covering an outer circumference of the conductive cored bar. The charging roller 12 is connected to a power source, and a predetermined superimposed voltage including a predetermined direct current (DC) voltage and/or a predetermined alternating current (AC) voltage is supplied to the charging roller 12. Accordingly, the charging roller 12 uniformly charges the surface of the photoconductor drum 11 disposed facing the charging roller 12.

In the present embodiment of this disclosure, the charging roller 12 is not disposed in contact with the photoconductor drum 11 but is disposed facing the photoconductor drum 11 across a relatively small gap. To be more specific, with reference to FIG. 5, rollers 40 are disposed at both ends of the charging roller 12 in the width direction (i.e., a direction perpendicular to the drawing sheet of FIG. 2 and a left and right direction of FIG. 5). Each of the rollers 40 has a ring shape and an outer diameter greater than an outer diameter of the charging roller 12. The charging roller 12 is biased so that the rollers 40 contact the surface of the photoconductor drum 11, thereby forming a desired gap between the photoconductor drum 11 and the charging roller 12.

The developing device 13 (i.e., a developing part) includes a developing roller 13*a*, a first conveying screw

13*b*, a second conveying screw 13*c*, and a doctor blade 13*d*. The developing roller 13*a* is disposed facing the photoconductor drum 11. The first conveying screw 13*b* is disposed facing the developing roller 13*a*. The second conveying screw 13*c* is disposed facing the first conveying screw 13*b* via a partition. The doctor blade 13*d* is disposed facing the developing roller 13*a*. The developing roller 13*a* includes magnet and a sleeve. The magnet includes a magnet roller or multiple magnets fixedly disposed inside the developing roller 13*a* and generates multiple magnetic poles around a circumferential surface of the developing roller 13*a*. The sleeve rotates about the magnet. The magnet forms multiple magnetic poles on (the sleeve of) the developing roller 13*a*, and developer G moves to be borne on the developing roller 13*a*.

The developer G is a two-component developer contained in the developing device 13. The developer G includes carrier C including carrier particles and toner T including toner particles.

In order to enhance image quality, the toner T in the present embodiment of this disclosure employs spherical toner having a roundness equal to or greater than 0.93 and has a ratio of (D4/D1) in a range of 1.00 to 1.40, where "D4" is a weight average particle diameter and "D1" is a number average particle diameter.

The roundness or circularity of the toner T is a perimeter of a circle having the same area as a particle projected area to a particle projected image. The circularity is obtained based on measured values by a flow-type particle image analyzer FPIA-2000, available from Sysmex Corporation.

Further, the weight average particle diameter and the number average particle diameter of the toner T are measured using a particle size analyzer Model SD2000, available from Hosokawa Micron Corporation.

As previously described, the cleaning device 14 includes the cleaning blade 14*a* and the conveyance screw 14*b*. The cleaning blade 14*a* contacts the photoconductor drum 11 to clean the surface of the photoconductor drum 11. The conveyance screw 14*b* conveys the toner T collected in the cleaning device 14 toward the outside the cleaning device 14.

The cleaning blade 14*a* includes a rubber material such as urethane rubber and contacts the surface of the photoconductor drum 11 at a predetermined angle with a predetermined pressure. According to this configuration, untransferred toner remaining on the surface of the photoconductor drum 11 is mechanically scraped and removed by the cleaning blade 14*a* to be collected to the cleaning case 14*d* of the cleaning device 14. The untransferred toner includes foreign materials such as lubricant applied to the photoconductor drum 11 by the lubricating device 15 (i.e., the lubricating devices 15Y, 15M, 15C, and 15K), powder dust from a recording medium P or recording media P, discharge products generated on the photoconductor drum 11 during electrical discharge by the charging roller 12, and additives added to toner.

It is to be noted that the cleaning blade 14*a* according to the present embodiment of this disclosure contacts the photoconductor drum 11 in a counter direction of movement (rotation) of the photoconductor drum 11.

Further, it is to be noted that the removed material receiver 14*c* is disposed below the cleaning device 14 to receive toner and lubricant failed to enter into the cleaning case 14*d* of the cleaning device 14. Details of the removed material receiver 14*c* are described below.

Figure 3:
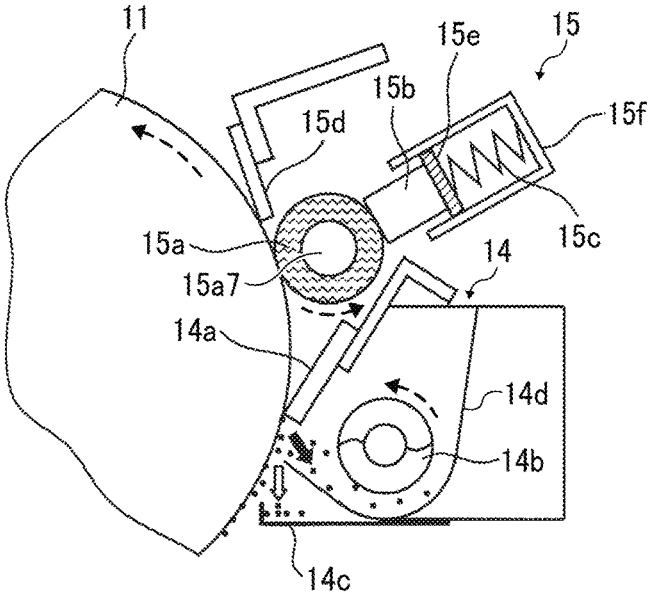
FIG. 3 is an enlarged view illustrating a lubricating device and a cleaning device included in the image forming apparatus.

FIG. 3 is an enlarged view illustrating the lubricating device 15 and the cleaning device 14 included in the image forming apparatus 1.

With reference to FIGS. 2 and 3, the lubricating device 15 includes a lubricant application roller 15*a*, a solid lubricant 15*b*, a compression spring 15*c*, a regulating blade 15*d*, a lubricant supporting member 15*e*, and a guide 15*f*. The lubricant application roller 15*a* includes an elastic foam layer that slidably contacts the photoconductor drum 11. The solid lubricant 15*b* slidably contacts the lubricant application roller 15*a* (the elastic foam layer). The compression spring 15*c* functions as a biasing body that biases the solid lubricant 15*b* toward the lubricant application roller 15*a*. The regulating blade 15*d* functions as a blade member that contacts the photoconductor drum 11 and making (regulating) lubricant applied onto the photoconductor drum 11 into a thin layer. The lubricant supporting member 15*e* functions as a holding plate to hold the solid lubricant 15*b*. The guide 15*f* functions as a lubricant holder to guide the solid lubricant 15*b* biased by the compression spring 15*c* to be held by the lubricant supporting member 15*e*.

The lubricating device 15 is disposed downstream from the cleaning device 14 (more specifically, the cleaning blade 14*a*) and upstream from the charging roller 12 in the direction of rotation of the photoconductor drum 11. The regulating blade 15*d* is disposed downstream from the lubricant application roller 15*a* in the direction of rotation of the photoconductor drum 11.

The lubricant application roller 15*a* is a roller that includes a shaft 15*a*1 and an elastic foam layer that covers the shaft 15*a*1. The shaft 15*a*1 includes a cored bar of a metallic material and the elastic foam layer includes foamed polyurethane (urethane foam). The lubricant application roller 15*a* rotates in a counterclockwise direction in FIG. 2 while the elastic foam layer is in contact with the surface of the photoconductor drum 11. According to this configuration, lubricant is applied from the solid lubricant 15*b* to the photoconductor drum 11 via the lubricant application roller 15*a*.

The lubricant application roller 15*a* is manufactured in a series of the following processes. A polyurethane foam to be used as an elastic foam layer is cut from a raw polyurethane foam into a block shape. Then, the block shape of the polyurethane foam is cut into a specific shape, and the surface of the cut polyurethane foam is polished. After the cored bar (the core material) is inserted into the polyurethane foam, the polyurethane foam is rotated. While the polyurethane foam is being rotated, a polishing blade slidably contacts and moves the polyurethane foam in parallel to an axial direction of the polyurethane foam. The polyurethane foam is ground (by traverse grinding) to a predetermined sponge thickness. The cored bar to be inserted into the polyurethane foam may be previously applied with an adhesive in order to increase adhesiveness between the cored bar and the elastic foam layer. Further, when performing the traverse grinding, a speed of rotation of the foamed polyurethane and a speed of movement of the foamed polyurethane are changed to form irregular projections and recesses on the surface of the elastic foam layer.

It is to be noted that a manufacturing method of the lubricant application roller 15*a* is not limited to the above-described manufacturing method. For example, a different manufacturing method in which a raw material of polyurethane foam is injected to harden the polyurethane foam can be applied to this disclosure.

The lubricant application roller 15*a* is rotated in a counter direction (i.e., the opposite direction) to the photoconductor drum 11 that rotates in the counterclockwise direction of FIG. 2. That is, the direction of rotation of the lubricant application roller 15*a* is opposite to the direction of rotation (movement) of the photoconductor drum 11 at a slidably contact position at which the lubricant application roller 15*a* and the photoconductor drum 11 contact each other.

In addition, the lubricant application roller 15*a* is disposed to slidably contact the solid lubricant 15*b* and the photoconductor drum 11. As the lubricant application roller 15*a* rotates, the lubricant application roller 15*a* scrapes lubricant from the solid lubricant 15*b* and applied the lubricant onto the photoconductor drum 11.

Further, the compression spring 15*c* is disposed on the back of the solid lubricant 15*b* (that is, behind the lubricant supporting member 15*e*) so as to reduce or avoid uneven contact between the lubricant application roller 15*a* and the solid lubricant 15*b*. The compression spring 15*c* biases the solid lubricant 15*b* toward the lubricant application roller 15*a*.

The solid lubricant 15*b* is produced by mixing inorganic lubricant into fatty acid metal zinc. As a preferable example of fatty acid metal zincs, the fatty acid metal zinc includes at least zinc stearate. As a preferable example of inorganic lubricant, the inorganic lubricant includes at least one of talc, mica, and boron nitride.

Zinc stearate is typical lamellar crystal powder. Lamellar crystals have a layered structure of amphiphilic molecules with self-organization. When a shearing force is applied, each crystal is broken along the interlayer to slip easily. Accordingly, the friction coefficient on the surface of the photoconductor drum 11 can be decreased. Specifically, due to the lamellar crystals that receive the shearing force and uniformly cover the surface of the photoconductor drum 11, the surface of the photoconductor drum 11 can be covered effectively with a small amount of lubricant. Therefore, the surface of the photoconductor drum 11 can be covered relatively uniformly so as to be preferably protected from electrical stress in the charging process.

Further, by using inorganic lubricant having a planar structure such as talc, mica, and boron nitride, occurrence of slipping of toner and lubricant from (the cleaning blade 14*a* of) the cleaning device 14 is substantially decreased, and therefore the charging roller 12 can be prevented from being contaminated.

Further, the solid lubricant 15*b* according to the present embodiment is manufactured by melting raw material powder, casting the melted raw material powder into a mold, and compressing and solidifying into a substantially rectangular shape. The solid lubricant 15*b* manufactured by the above-described method can simplify manufacturing facility, and therefore can achieve a reduction in cost of parts and components.

The regulating blade 15*d* that functions as a blade member is a plate including a rubber material such as a urethane rubber. The regulating blade 15*d* contacts the surface of the photoconductor drum 11 at a predetermined angle with a predetermined pressure. The regulating blade 15*d* is disposed downstream from the cleaning blade 14*a* in the direction of rotation (movement) of the photoconductor drum 11. The lubricant applied onto the photoconductor drum 11 by the lubricant application roller 15*a* is regulated by the regulating blade 15*d* into a uniform and adequate layer on the photoconductor drum 11.

By applying the solid lubricant 15*b* to the surface of the photoconductor drum 11 via the lubricant application roller 15*a*, the lubricant is applied on the photoconductor drum 11 in powder form. With such powder form lubricant, the lubricating performance cannot be achieved fully. In order to address this inconvenience, the regulating blade 15*d* functions as a member to regulate the powder lubricant into a sufficiently thin and uniform layer. After making the powder lubricant into a film coating lubricant on the photoconductor drum 11, the lubricant can achieve the lubricating performance fully.

The regulating blade 15*d* according to the present embodiment of this disclosure contacts the photoconductor drum 11 in the counter direction of movement (rotation) of the photoconductor drum 11. The regulating blade 15*d* contacts the photoconductor drum 11 at a predetermined pressure in a range of 10 g/cm to 60 g/cm and a predetermined contact angle θ in a range of 75 degrees to 90 degrees. By contacting the regulating blade 15*d* to the photoconductor drum 11 in the counter direction, the lubricant can be applied onto the photoconductor drum 11 into a thin layer efficiently.

The term the predetermined "contact angle θ" is an angle of a virtual line passing an edge of the regulating blade 15*d* and a tangential line (i.e., a line perpendicular to a normal line) to the contact position of the photoconductor drum 11 and the regulating blade 15*d* in a state in which the regulating blade 15*d* contacts the photoconductor drum 11 to be bent.

As described above, the configuration of the present embodiment includes two blade members, which are the cleaning blade 14*a* and the regulating blade 15*d*, separately. According to this configuration, the cleaning performance and the lubricant application performance are maintained preferably and, at the same time, abrasion and deterioration of both of the cleaning blade 14*a* and the regulating blade 15*d* can be reduced due to application of lubricant onto the surface of the photoconductor drum 11.

In the present embodiment, abrasion-resistive material coating such as a fluororesin coating is performed to the surface of the cleaning blade 14*a* and the surface of the regulating blade 15*d*. Consequently, both the cleaning blade 14*a* and the regulating blade 15*d* can reduce degree of deterioration due to friction. In other words, the durability of the cleaning blade 14*a* and the regulating blade 15*d* can be enhanced.

With reference to FIG. 3, the lubricant supporting member 15*e* that functions as a holding plate to hold the solid lubricant 15*b* that is adhered to one side thereof.

The guide 15*f* functions as a box-shaped lubricant holder inside which part of the solid lubricant 15*b*, the lubricant supporting member 15*e*, and the compression spring 15*c* are accommodated. The lubricant supporting member 15*e* is disposed to slidably contact an inner wall face of the guide 15*f*. One end of the compression spring 15*c* is connected to an inner bottom face of the guide 15*f*. The other end (i.e., an end opposite the one end) of the compression spring 15*c* is connected to the lubricant supporting member 15*e*. With this configuration, as the solid lubricant 15*b* is used and consumed, the lubricant supporting member 15*e* slides along the guide 15*f* while being biased by the compression spring 15*c* and being guided by the guide 15*f*. Accordingly, the solid lubricant 15*b* is pressed against the lubricant application roller 15*a*.

A detailed description of the image forming processes is given with reference to FIG. 2.

The developing roller 13*a* rotates in a direction indicated by arrow in FIG. 2. The first conveying screw 13*b* and the second conveying screw 13*c* are disposed facing each other with the partition interposed therebetween. The first conveying screw 13*b* rotates in a direction indicated by arrow in FIG. 2. The second conveying screw 13*c* rotates in a direction indicated by arrow in FIG. 2. As the first conveying screw 13*b* and the second conveying screw 13*c* rotate in the respective directions in FIG. 2, the developer G stored in the developing device 13 is circulated in the longitudinal direction of the developing device 13 (i.e., in a direction orthogonal to the drawing sheet of FIG. 2) while being stirred and mixed with the toner T supplied from a toner supplying unit 30 via a toner supplying port.

The toner T is electrically charged by friction with the carrier C. Both the toner T and the carrier C are held on the developing roller 13*a*. As the developing roller 13*a* moves, the developer G held on the developing roller 13*a* comes to the doctor blade 13*d*. After having been adjusted to an appropriate amount by the doctor blade 13*d*, the developer G then comes to an opposing position to the photoconductor drum 11 (i.e., a developing region).

Then, the toner T of the developer G adheres to the electrostatic latent image formed on the surface of the photoconductor drum 11 in the development region. To be more specific, the toner T adheres to the electrostatic latent image by an electric field generated by a potential difference (i.e., a developing potential) between a latent image potential (i.e., an exposure potential) of an image area to which the laser light beam L is emitted and a developing bias applied to the developing roller 13*a*.

Thereafter, the toner T attached to the photoconductor drum 11 in the developing process is transferred onto the intermediate transfer belt 17. Thereafter, the toner T attached to the photoconductor drum 11 in the developing process is transferred onto the intermediate transfer belt 17. Then, as the photoconductor drum 11 rotates after the cleaning process, the surface of the photoconductor drum 11 sequentially passes the lubricating device 15 and the electric discharging device. After these processes, a series of image forming processes of the photoconductor drum 11 is completed.

The toner supplying unit 30 provided to the apparatus body 1A includes a toner bottle 31 and a toner hopper 32. It is to be noted that the toner supplying unit 30 includes toner supplying units 30 for respective colors of yellow, magenta, cyan, and black having identical structure to each other except for the colors. The toner bottle 31 is replaceable to a new bottle for replenishing new toner T. The toner hopper 32 supplies the new toner T to the developing device 13 while holding and rotating the toner bottle 31. The toner bottle 31 contains and is filled with the new toner T. In addition, the toner bottle 31 has an inner circumferential surface with a spiral projection formed thereon.

It is to be noted that, as the toner T that is supplied to the developing device 13 is consumed, the new toner T contained in the toner bottle 31 is replenished appropriately to the developing device 13 via the toner supplying port. Consumption of the toner T in the developing device 13 is detected by a reflection type photosensor disposed facing the photoconductor drum 11 and a magnetic sensor disposed below the second conveying screw 13*c* of the developing device 13 directly or indirectly.

Next, a description is given of a configuration and functions of the removed material receiver 14*c* according to the present embodiment.

With reference to FIGS. 2 and 3, the removed material receiver 14*c* according to the present embodiment is disposed below the cleaning device 14 (of the process cartridge 10) and below the contact position at which the cleaning blade 14*a* contacts the photoconductor drum 11 that functions as an image bearer. The removed material receiver 14*c* receives foreign materials (leaked materials) failed to enter into the cleaning case 14*d* of the cleaning device 14 and leaked from the cleaning case 14*d* of the cleaning device 14 where the cleaning blade 14*a* removes and collects the foreign materials attached to the surface of the photoconductor drum 11. Specifically, while the foreign material attached to the surface of the photoconductor drum 11 is removed by the cleaning blade 14*a* and collected and conveyed in a direction indicated by black arrow of FIG. 3, part of the foreign material is spilled in a direction indicted by white arrow from the cleaning case 14*d* of the cleaning device 14. The spilled foreign material (i.e., the leaked material) is received by the removed material receiver 14*c*. To be more specific, the removed material receiver 14*c* receives the foreign material (i.e., the leaked material) spilled and leaked in the white arrow in FIG. 3 from the cleaning case 14*d* of the cleaning device 14 that normally collects the foreign material in the black arrow in FIG. 3. Examples of the foreign materials (i.e., the leaked materials) to be received by the removed material receiver 14*c* include untransferred toner and lubricant applied to the photoconductor drum 11 by the lubricating device 15.

Figure 4A:
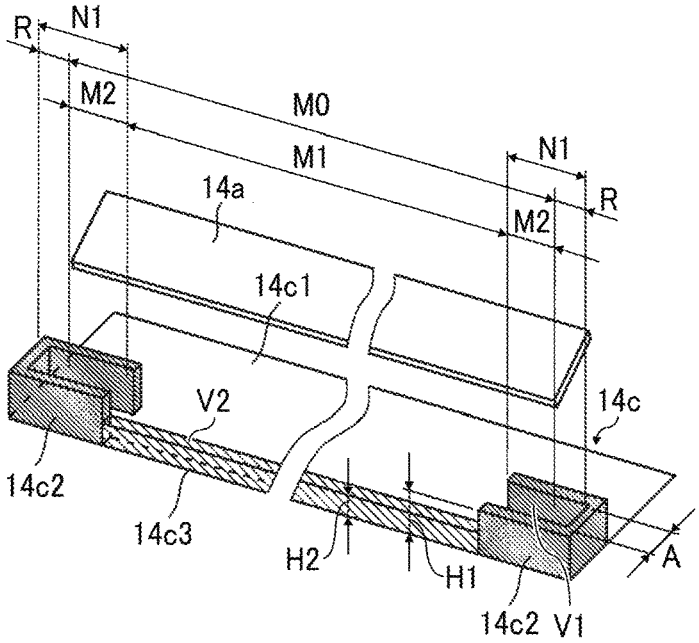
FIG. 4A is a perspective view illustrating a removed material receiver and a cleaning blade included in the image forming apparatus.
Figure 4B:
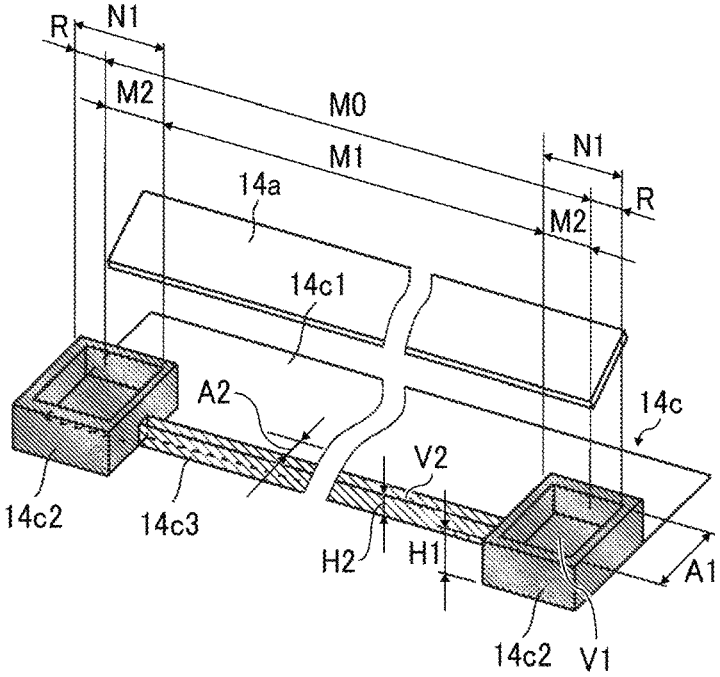
FIG. 4B is a perspective view illustrating another removed material receiver and the cleaning blade included in the image forming apparatus.

Here, FIG. 4A is a perspective view illustrating the removed material receiver 14*c* and the cleaning blade 14*a* included in the image forming apparatus 1. FIG. 4B is a perspective view illustrating another removed material receiver 14*c* and the cleaning blade 14*a* included in the image forming apparatus 1. The removed material receiver 14*c* according to the present embodiment includes a volume V1 per unit length in a width direction of a first range N1 that corresponds to an end portion M2 at both ends in a width direction of the cleaning blade 14*a* and a volume V2 per unit length in a width direction of a second range M1 that corresponds to a center in the width direction of the cleaning blade 14*a*. As illustrated in FIG. 4A, the volume V1 is set to be greater than the volume V2, which is expressed by an inequality of V1>V2. Specifically, the removed material receiver 14*c* according to the present embodiment is designed to store a greater amount of foreign materials (i.e., leaked materials) in the first range N1 of the removed material receiver 14*c* at both ends in the width direction of the cleaning blade 14*a* than the second range M1 at the center in the width direction of the cleaning blade 14*a*.

To be more specific, with reference to FIG. 4A, the first range N1 of the removed material receiver 14*c* is surrounded by walls 14*c*2 on three sides. The volume is substantially determined by a height H1 of each wall 14*c*2 to be A×H1×N1. ("A" is a lateral length perpendicular to the width direction of the removed material receiver 14*c* in each first range N1.) Therefore, the volume V1 per unit length in the width direction of the first range N1 is substantially obtained as A×H1 (=A×H1×N1/N1).

By contrast, the second range M1 of the removed material receiver 14*c* is surrounded by an upright portion 14*c*3 on the leading end side, the walls 14*c*2 on opposed sides, and the wall of the cleaning device 14 on the trailing end side. The volume is substantially determined by a height H2 of the upright portion 14*c*3 to be A×H2×M1. Therefore, the volume V2 per unit length in the width direction of the second range M1 is substantially obtained as A×H2 (=A×H2×M1/M1).

The height H1 of each wall 14*c*2 is sufficiently high when compared with the height H2 of the upright portion 14*c*3 and is disposed at a position not to interfere with the photoconductor drum 11. Accordingly, the removed material receiver 14*c* according to the present embodiment includes the volume V1 in a width direction of the first range N1 that corresponds to the end portion M2 at both ends in the width direction of the cleaning blade 14*a* is greater than the volume V2 per unit length in the width direction of the second range M1 that corresponds to the center in the width direction of the cleaning blade 14*a*.

It is to be noted that the height H2 of the upright portion 14*c*3 is set to be as high as possible within a range that does not interfere with the photoconductor drum 11.

As described above, the removed material receiver 14*c* is provided to store more foreign materials (i.e., more leaked materials) at the end portion M2 (at both ends) in the width direction (i.e., the first range N1) than at the center in the width direction (i.e., the second range M1). This is because an amount of foreign materials (i.e., leaked materials) that are spilled without being collected into the cleaning case 14*d* of the cleaning device 14 increases in a range corresponding to each end portion M2 in the width direction of the cleaning blade 14*a*. The foreign materials such as toner collected into the cleaning device 14 move to be dispersed toward the ends of the cleaning blade 14*a* in the width direction where toner particles less interfere with each other. Therefore, the foreign materials are spilled or leaked easily at ends in the width direction of the cleaning case 14*d* of the cleaning device 14.

Specifically, since lubricant that is applied to the surface of the photoconductor drum 11 by (the lubricant application roller 15*a* of) the lubricating device 15 is susceptible to the charging bias at the opposing position to the charging roller 12, the lubricant is spent by scattering. Therefore, with reference to FIG. 5, in a region outside a charging region BO of the charging roller 12 (in other words, an outside region in the width direction including the positions of respective rollers 40 are disposed), lubricant applied on the photoconductor drum 11 is brought into (the cleaning blade 14*a* of) the cleaning device 14 with being hardly consumed. Therefore, at the end portion M2 at both ends in the width direction of the cleaning blade 14*a*, a large amount of lubricant on the photoconductor drum 11 cannot be spent sufficiently and part of remaining lubricant leaks easily in a downward direction.

By contrast, in the present embodiment of this disclosure, the removed material receiver 14*c* is provided such that the volume V1 corresponding to the end portion M2 at both ends in the width direction of the cleaning blade 14*a* is greater than the volume V2 corresponding to the center M1 in the width direction of the cleaning blade 14*a*. Therefore, occurrence of the failure in which a large amount of foreign materials (i.e., the lubricant) leaking from the end portion M2 at both ends contaminates the inside of the cleaning device 14 with the foreign materials can be reduced reliably.

Here, with reference to FIG. 4A, the removed material receiver 14*c* according to the present embodiment includes the first range N1 that extends to a region R that corresponds to a range M0 in the width direction of the cleaning blade 14*a*. That is, the first range N1 of the removed material receiver 14*c* does not match the range of the end portion M2 in the width direction of the cleaning blade 14*a* but extends beyond the end portion M2 and matches the range including the region R added to the end portion M2 at both ends in the width direction of the cleaning blade 14*a*. The first range N1 can be expressed as N1≈(nearly equal to) M2+R.

By providing this configuration, the amount of foreign materials (specifically, lubricant) that can be stored in the first range N1 of the removed material receiver 14*c* further increases, and therefore the above-described effect of this disclosure can be exerted more reliably.

The height H1 and/or the lateral length A perpendicular to the width direction of the removed material receiver 14*c* in the first range N1 is greater than the height H2 and/or the lateral length A perpendicular to the width direction in the second range M1. According to this configuration, the volume V1 of the removed material receiver 14*c* is greater than the volume V2 of the removed material receiver 14*c*, as described above.

Accordingly, the removed material receiver 14*c* is not limited to the configuration illustrated in FIG. 4A but can be applied to a configuration illustrated in FIG. 4B.

Specifically, the first range N1 of the removed material receiver 14*c* in FIG. 4B is surrounded by the walls 14*c*2 on four sides. The volume is substantially determined by the height H1 of each wall 14*c*2 to be A1×H1×N1. In comparison to the lateral length A of FIG. 4A, a lateral length A1 of each of the walls 14*c*2 is more projected toward the leading end of the removed material receiver 14*c*.

By contrast, the second range M1 of the removed material receiver 14*c* in FIG. 4B is surrounded by the upright portion 14*c*3 on the leading end side, the walls 14*c*2 on opposed sides, and the wall of the cleaning device 14 on the trailing end side. The volume is substantially determined by the height H2 of the upright portion 14*c*3 to be A2×H2×M1. (The reference letter "A2" indicates a lateral length perpendicular to the width direction of the removed material receiver 14*c* in the second range M1.)

Accordingly, even when the removed material receiver 14*c* has the above-described configuration, the volume V1 (≈A1×H1) per unit length in the width direction of the first range N1 is greater than the volume V2 (≈A2×H2) per unit length in the width direction of the second range M1. Therefore, the above-described effect of this disclosure can be exerted.

With reference to FIGS. 4A and 4B, the removed material receiver 14*c* according to the present embodiment includes a bottom portion 14*c*1 that functions as a base, an upright portion 14*c*3, and walls 14*c*2.

The bottom portion 14*c*1 is an elastic planar member having a substantially rectangular shape. The bottom portion 14*c*1 has a leading end portion and a root portion. The root portion of the bottom portion 14*c*1 is attached to a bottom of the cleaning device 14 (of the process cartridge 10) such that the leading end portion of the bottom portion 14*c*1 faces the photoconductor drum 11. The bottom portion 14*c*1 according to the present embodiment includes an elastic material such as a transparent PET (polyethylene terephthalate) having the thickness of 0.5 mm to 1.5 mm. The bottom portion 14*c*1 is flexible but is not bent or warped due to the weight of foreign material on the bottom portion 14*c*1. That is, the bottom portion 14*c*1 can hold foreign materials without being bent. The bottom portion 14*c*1 is formed by an elastic material. Therefore, even if the removed material receiver 14*c* contacts the photoconductor drum 11 during attachment and detachment of the removed material receiver 14*c* relative to the photoconductor drum 11, the removed material receiver 14*c* is deformed entirely, so as not do any damage to the surface of the photoconductor drum 11 easily. Since the removed material receiver 14*c* is transparent, a user can easily recognize foreign material such as toner and lubricant on the removed material receiver 14*c* by sight.

The upright portion 14*c*3 of the removed material receiver 14*c* is disposed extending upright and upwardly from the bottom portion 14*c*1 at the leading end portion of the bottom portion 14*c*1 on a side close to the photoconductor drum 11 that functions as an image bearer in the second range M1. The upright portion 14*c*3 has a substantially rectangular shape formed by rubber and is adhered to the leading end portion of the bottom portion 14*c*1. Since the upright portion

14*c*3 includes a rubber material, a space to store the foreign materials on the bottom portion 14*c*1 formed by an elastic member and, at the same time, the damage to the photoconductor drum 11 is reduced even when the removed material receiver 14*c* contacts the photoconductor drum 11.

The walls 14*c*2 of the removed material receiver 14*c* extends upright and upwardly, surrounding the first range N1 except one side close to the center in the width direction, as illustrated in FIG. 4A. Each of the walls 14*c*2 has a box shape formed by a sponge material such as foamed polyurethane and is adhered to the leading end side in the width direction of both ends of the bottom portion 14*c*1. Since the walls 14*c*2 are formed by a sponge material, a space to store the foreign materials on the bottom portion 14*c*1 formed by an elastic member and, at the same time, the damage to the photoconductor drum 11 is reduced even when the removed material receiver 14*c* contacts the photoconductor drum 11.

As described above with reference to FIGS. 2 and 3, the process cartridge 10 (i.e., the process cartridges 10Y, 10M, 10C, and 10K of the image forming apparatus 1) includes the photoconductor drum 11, the lubricant application roller 15*a* to apply lubricant onto the surface of the photoconductor drum 11 that functions as an image bearer, the regulating blade 15*d* that functions as a blade member to regulate the lubricant applied on the surface of the photoconductor drum 11 into a thin layer, the charging roller 12 to uniformly charge the surface of the photoconductor drum 11, and the developing roller 13*a* to develop an electrostatic latent image formed on the surface of the photoconductor drum 11 into a visible toner image.

The image forming apparatus 1 according to the present embodiment further includes the intermediate transfer belt 17 onto which the toner image formed on the photoconductor drum 11 is primarily transferred, and the primary transfer roller 16 to contact the photoconductor drum 11 via the intermediate transfer belt 17.

Figure 5:
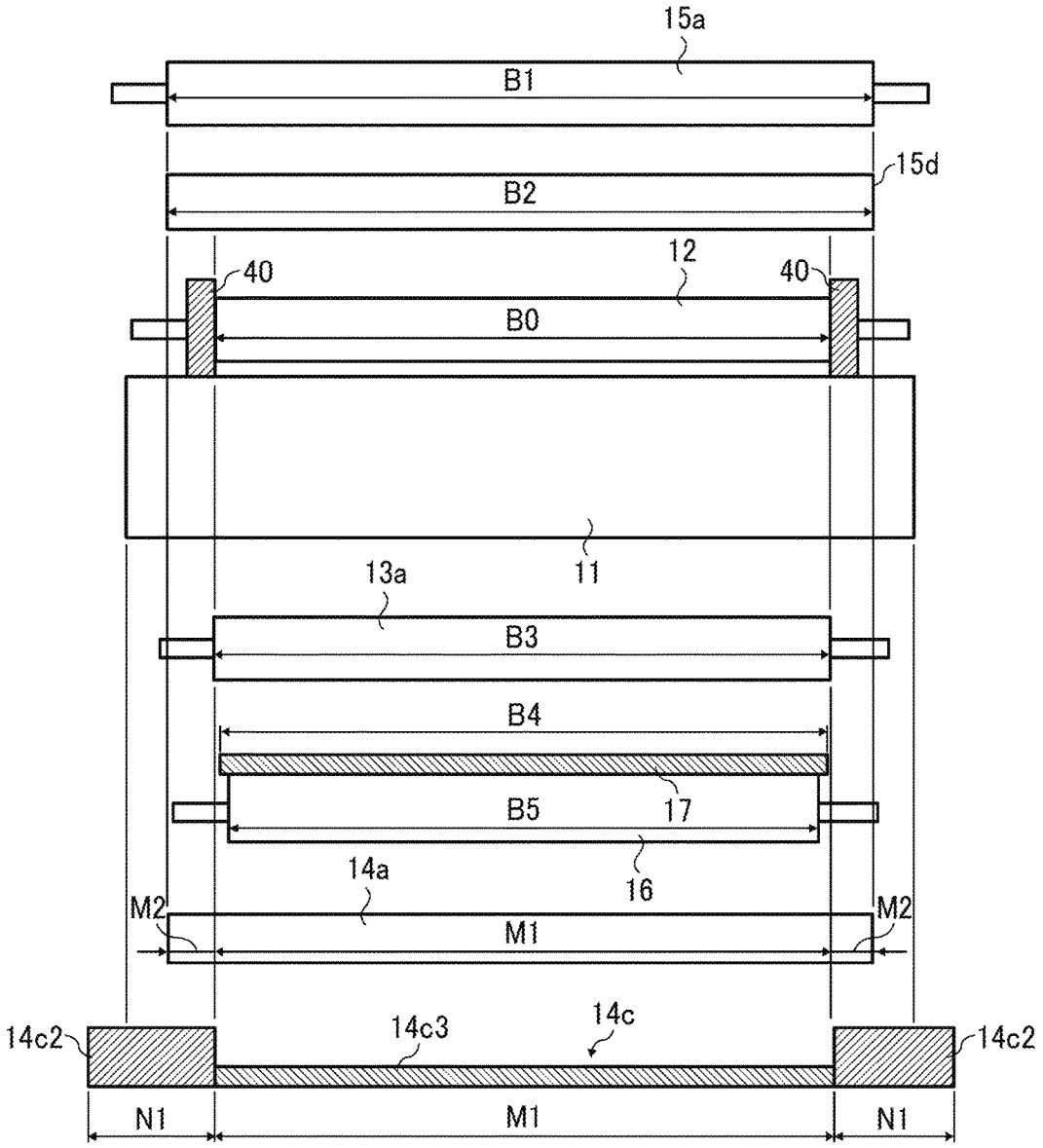
FIG. 5 is a diagram illustrating a relation of various image forming members and the removed material receiver in respective lateral lengths.

FIG. 5 is a diagram illustrating a relation of various image forming members and the removed material receiver 14*c* in respective lateral lengths.

With reference to FIG. 5, the lubricant application roller 15*a* according to the present embodiment has a lubricant application range B1 in the width direction that substantially matches the range M0 in the width direction of the cleaning blade 14*a*. The range M0 can be expressed as M0=M1+M2×2. With this configuration, the lubricant is applied to the edge portion of the cleaning blade 14*a* over the width direction of the cleaning blade 14*a*. Accordingly, the sliding resistance between the cleaning blade 14*a* and the photoconductor drum 11 increases, and therefore a failure such as breakage or curling of the cleaning blade 14*a* can be reduced reliably. It is to be noted that the solid lubricant 15*b* has a range to substantially match the lubricant application range B1, from the same reasons as the above-described cleaning blade 14*a*.

Further, from the same reasons, the regulating blade 15*d* (functioning as a blade member) has a range B2 in the width direction that substantially matches the range M0 in the width direction of the cleaning blade 14*a*.

Further, the charging roller 12 has a charging range B2 in the width direction that substantially matches the second range M1 of the removed material removed material receiver 14*c*. In other words, the second range M1 of the removed material receiver 14*c* is set to match the charging range B0 of the charging roller 12, and therefore the removed material receiver 14*c* has the first range N1 that extends outside the second range M1.

Accordingly, as described above, in the region outside the charging region BO of the charging roller 12 (that is, an outside region in the width direction including the positions of the respective rollers 40 are disposed), lubricant applied on the photoconductor drum 11 that is hardly used and is brought into (the cleaning blade 14*a* of) the cleaning device 14 with being hardly consumed. Therefore, even when a large amount of lubricant on the photoconductor drum 11 cannot be spent sufficiently in the end portion M2 at both ends in the width direction of the cleaning blade 14*a* and part of remaining lubricant leaks, the leaked lubricant can be received reliably by the removed material receiver 14*c* in the first range N1.

Further, the developing roller 13*a* has a developing range B3 in the width direction that is substantially equal to or smaller than the second range M1 of the removed material receiver 14*c* (or the charging region BO of the charging roller 12).

Accordingly, the developing process is performed based on the charging region BO that functions as a background area of the photoconductor drum 11. Therefore, a failure in which a large amount of background contamination toner is adhered to both ends in the width direction of the photoconductor drum 11 can be avoided. At the same time, even when the lubricant is inputted into (the cleaning blade 14*a* of) the cleaning device 14 without entering the inside of the developing device 13 via the developing roller 13*a* and part of the lubricant is not removed in the end portion M2 at both ends in the width direction of the cleaning blade 14*a* and is leaked from the cleaning device 14, the leaked lubricant can be received reliably by the removed material receiver 14*c* in the first range N1.

It is to be noted that the developing range B3 of the developing roller 13*a* is set to substantially match the second range M1, as illustrated in FIG. 5.

Further, the intermediate transfer belt 17 has a region B4 in the width direction that substantially matches or smaller than the second range M1 of the removed material receiver 14*c* (or the charging region BO of the charging roller 12 or the developing region B3 of the developing device 13).

Accordingly, the toner image formed on the photoconductor drum 11 is transferred onto the intermediate transfer belt 17 reliably. At the same time, a failure in which a large amount of lubricant on the photoconductor drum 11 at both ends in the width direction of the photoconductor drum 11 (corresponding to the first range N1) is adhered to the intermediate transfer belt 17 can be avoided.

It is to be noted that the region B4 in the width direction of the intermediate transfer belt 17 is arranged to be smaller than the second range M1, as illustrated in FIG. 5.

Further, the primary transfer roller 16 has a primary transfer region B5 in the width direction that is substantially equal to or smaller than the region B4 in the width direction of the intermediate transfer belt 17.

Accordingly, the primary transfer roller 16 does not contact the photoconductor drum 11 directly but contacts the photoconductor drum 11 indirectly or via the intermediate transfer belt 17. At the same time, a failure in which a large amount of lubricant attached to both ends in the width direction of the photoconductor drum 11 (corresponding to the first range N1) adheres to the intermediate transfer belt 17 can be avoided.

It is to be noted that the primary transfer region B5 is arranged to be smaller than the region B4 in the width direction of the in the intermediate transfer belt 17, as illustrated in FIG. 5.

It is to be noted that the region in the width direction of the photoconductor drum 11 is set to include any one of the above-described ranges B0 through B5 (except for the first range N1 of the removed material receiver 14*c*). Accordingly, desired image forming processes are performed preferably on the surface of the photoconductor drum 11.

As described above, the removed material receiver 14*c* according to the present embodiment has the volume per unit length in the width direction in the first range N1 that correspond to both ends in the width direction of the cleaning blade 14*a* is greater than the volume per unit length in the width direction in the second range M1 that corresponds to the center in the width direction of the cleaning blade 14*a*.

According to this configuration, the removed material receiver 14*c* receives foreign materials (leaked materials) leaked from the cleaning blade 14*a* over the entire width direction.

It is to be noted that the cleaning device 14 including the removed material receiver 14*c* is integrated with the photoconductor drum 11, the charging roller 12, the developing device 13, and the lubricating device 15 to form the process cartridge 10, so as to reduce the size of the image forming unit and enhance the maintenance work.

By contrast, the cleaning device 14 provided with the removed material receiver 14*c* may be employed as a member of a process cartridge but may be a single member that can be replaced to the apparatus body 1A. In this case, the cleaning device 14 including the removed material receiver 14*c* can achieve the same effect as the cleaning device 14 included in the process cartridge.

It is to be noted that the term "process cartridge" is defined as an integrated unit that includes an image bearer and at least one of a charging part that charges the image bearer, a developing part (a developing device) to develop a latent image formed on the image bearer, and a cleaning part (a cleaning device) to clean the surface of the image bearer, and is detachably attached to an apparatus body of an image forming apparatus.

Further, in the present embodiment of this disclosure, the removed material receiver 14*c* is included in the cleaning device 14 (of the process cartridge 10) as a member of the cleaning device 14. However, the removed material receiver 14*c* may not be a member of the cleaning device 14 but may be employed as a single member separate from the cleaning device 14.

In addition, in the present embodiment of this disclosure, the charging roller 12 is disposed facing the photoconductor drum 11 without contacting across a small gap. However, the charging roller 12 may be pressed against the photoconductor drum 11.

Even in this case, the charging roller 12 can achieve the same effect as the charging roller 12 described in the present embodiment.

It is to be noted that, in this disclosure, the phrase "A and/or B" is defined to be read as "at least one of A and B".

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A cleaning device comprising:

a cleaning blade configured to remove a material attached to a surface of an image bearer;

a cleaning case configured to contain the material removed by the cleaning blade; and a removed material receiver configured to receive the material failed to enter into the cleaning case when the material is removed by the cleaning blade, the removed material receiver having a first range at both ends in a width direction of the cleaning blade and a second range at a center in the width direction of the cleaning blade, a volume per unit length in a width direction of the first range being greater than a volume per unit length in a width direction of the second range.

2. The cleaning device according to claim 1, wherein the first range of the removed material receiver extends beyond an end portion in the width direction of the cleaning blade.

3. The cleaning device according to claim 1, wherein at least one of a vertical length and a lateral length perpendicular to a width direction in the first range of the removed material receiver is greater than at least one of a vertical length and a lateral length perpendicular to the width direction in the second range of the removed material receiver.

4. The cleaning device according to claim 1, wherein the removed material receiver comprising:

a bottom portion disposed in a lower part of the cleaning device, below a position at which the cleaning blade contacts the image bearer, the bottom portion including an elastic plate;

an upright portion extending upright from the bottom portion, at a leading end of the bottom portion on an image bearer side in the second range, the upright portion including a rubber; and a wall extending upright and surrounding an area other than a lateral center area of the bottom portion in the first range, the wall including a sponge.

5. A process cartridge detachably attachable to an apparatus body of an image forming apparatus, the process cartridge comprising:

the cleaning device according to claim 1; and an image bearer disposed close to the cleaning device.

6. The process cartridge according to claim 5, further comprising:

a lubricant application roller configured to apply a lubricant to a surface of the image bearer in a lubricant application range extending in a width direction thereof, the lubricant application range being substantially equal to a width range of the cleaning blade;

a regulating body configured to regulate the lubricant applied on the surface of the image bearer in a lubricant regulation range extending in a width direction thereof, the lubricant regulation range being substantially equal to the width range of the cleaning blade;

a charging body configured to charge the surface of the image bearer in a charging range extending in a width direction thereof, the charging range being substantially equal to the second range; and a developing body configured to develop a latent image formed on the surface of the image bearer in a developing range extending in a width direction thereof, the developing range being substantially equal to or smaller than the second range.

7. An image forming apparatus comprising:

the cleaning device according to claim 1; and an image bearer disposed close to the cleaning device.

8. The image forming apparatus according to claim 7, further comprising:

a lubricant application roller configured to apply a lubricant to a surface of the image bearer in a lubricant application range extending in a width direction thereof, the lubricant application range being substantially equal to a width range of the cleaning blade;

a regulating body configured to regulate the lubricant applied on the surface of the image bearer in a lubricant regulation range extending in a width direction thereof, the lubricant regulation range being substantially equal to the width range of the cleaning blade;

a charging body configured to charge the surface of the image bearer in a charging range extending in a width direction thereof, the charging range being substantially equal to the second range; and a developing body configured to develop a latent image formed on the surface of the image bearer into a toner image in a developing range extending in a width direction thereof, the developing range being substantially equal to or smaller than the second range.

9. The image forming apparatus according to claim 7, further comprising:

an intermediate transfer body onto which a toner image formed on the surface of the image bearer is transferred in an image receiving range extending in a width direction thereof, the image receiving range being substantially equal to or smaller than the second range; and a primary transfer body disposed in contact with the image bearer via the intermediate transfer body in a primary transfer range extending in a width direction thereof, the primary transfer range being substantially equal to or smaller than the image receiving range in the width direction of the intermediate transfer body.

10. A cleaning device comprising:

a cleaning blade configured to remove a material attached to a surface of an image bearer;

a cleaning case configured to contain the material removed by the cleaning blade; and a removed material receiver configured to receive the material failed to enter into the cleaning case when the material is removed by the cleaning blade, the removed material receiver having a first range at both ends in a width direction of the cleaning blade and a second range at a center in the width direction of the cleaning blade, the removed material receiver comprising:

a bottom portion disposed in a lower part of the cleaning device, below a position at which the cleaning blade contacts the image bearer, the bottom portion including an elastic plate;

an upright portion extending upright from the bottom portion, at a leading end of the bottom portion on an image bearer side in the second range, the upright portion including a rubber; and a wall extending upright and surrounding an area other than a lateral center area of the bottom portion in the first range, the wall including a sponge.

11. The cleaning device according to claim 10, wherein the first range of the removed material receiver extends beyond an end portion in the width direction of the cleaning blade.

12. The cleaning device according to claim 10, wherein at least one of a vertical length and a lateral length perpendicular to a width direction in the first range of the removed material receiver is greater than at least one of a vertical length and a lateral length perpendicular to the width direction in the second range of the removed material receiver.

13. A process cartridge detachably attachable to an apparatus body of an image forming apparatus, the process cartridge comprising:

the cleaning device according to claim 10;

an image bearer disposed close to the cleaning device;

a lubricant application roller configured to apply a lubricant to a surface of the image bearer in a lubricant application range extending in a width direction thereof, the lubricant application range being substantially equal to a width range of the cleaning blade;

a regulating body configured to regulate the lubricant applied on the surface of the image bearer in a lubricant regulation range extending in a width direction thereof, the lubricant regulation range being substantially equal to the width range of the cleaning blade;

a charging body configured to charge the surface of the image bearer in a charging range extending in a width direction thereof, the charging range being substantially equal to the second range; and a developing body configured to develop a latent image formed on the surface of the image bearer in a developing range extending in a width direction thereof, the developing range being substantially equal to or smaller than the second range.

14. An image forming apparatus comprising the process cartridge according to claim 13.

* * * * *